United States Patent [19]

Hamano

[11] 4,076,496

[45] Feb. 28, 1978

[54] COLORING METHOD FOR SYNTHETIC RESIN

[75] Inventor: Tadashi Hamano, Tokyo, Japan

[73] Assignee: Kabushiki Kaisha Daini Seikosha, Japan

[21] Appl. No.: 595,900

[22] Filed: Jul. 15, 1975

[30] Foreign Application Priority Data

Jul. 17, 1974 Japan ..... 49-81153

[51] Int. Cl.[2] ..... D06P 3/00

[52] U.S. Cl. ..... 8/4; 8/73; 8/92; 427/282; 427/385 B; 427/430 R

[58] Field of Search ..... 427/282, 430, 385 B; 8/4, 73, 92

[56] References Cited

U.S. PATENT DOCUMENTS

| | | | |
|---|---|---|---|
| 3,340,087 | 9/1967 | Mazzola | 427/282 |
| 3,434,865 | 3/1969 | Daquire et al. | 427/282 |
| 3,498,828 | 3/1970 | Small | 427/385 B |
| 3,625,731 | 12/1971 | Taylor | 427/282 |

*Primary Examiner*—Ronald H. Smith
*Assistant Examiner*—Janyce A. Bell
*Attorney, Agent, or Firm*—Robert E. Burns; Emmanuel J. Lobato; Bruce L. Adams

[57] ABSTRACT

Coloring method for synthetic resin articles is disclosed. The aqueous solution which colors the resin surface comprises at least one polyacid having chemical formula $HO_2C(CH_2)_nCO_2H$; at least one polyhydric alcohol and water including a small quantity of the coloring dye. The article is dipped or treated with the aqueous solution heated to a temperature less than the softening temperature of the resin. The coloring is achieved within a few minutes of treatment.

9 Claims, No Drawings

COLORING METHOD FOR SYNTHETIC RESIN

BACKGROUND OF THE INVENTION

This invention relates to a coloring method for synthetic resin articles without damaging actions on the resin surface of the article, such as swelling or melting. In general, the surface of synthetic resin articles is colored by painting, printing or dyeing. Another coloring method for synthetic resin is to scatter pigment into resin itself before forming. If we color resin by painting or printing, it becomes opaque and loses brightness and smoothness of the surface of resin. Since the surface of resin is swollen by dyeing, an after-treatment is required which takes a long time. In the dye dispersion method, color tone adjustment is often required while resin is in the raw state and it is rather difficult to get desired color or tone. According to this method, large amounts of raw resin must be treated at the same time from the economical point of view.

SUMMARY OF THE INVENTION

In accordance with the present invention, the synthetic resin article is immersed or treated with an aqueous coloring solution at a temperature less than the softening temperature of said resin, the coloring solution comprising at least one polyacid having the chemical formula $HO_2C(CH_2)_nCO_2H$, at least one polyhydric alcohol and the desired dye in water. The suitable polyacids according to the invention include any of adipic acid ($HO_2C(CH_2)_4CO_2H$), pimelic acid ($HO_2C(CH_2)_5CO_2H$), suberic acid ($HO_2C(CH_2)_6CO_2H$), azelaic acid ($HO_2C(CH_2)_7CO_2H$), sebacic acid ($HO_2C(CH_2)_8CO_2H$), dodecanedioic acid ($HO_2C(CH_2)_{10}CO_2H$), brassylic acid ($HO_2C(CH_2)_{11}CO_2H$), tetradecanedioic acid ($HO_2C(CH_2)_{12}CO_2H$) and similar dibasic acids where $n$ is at least 4 and may range to 20. The polyhydric alcohols according to the invention include, among dihydric alcohols, ethylene glycol ($HOCH_2CH_2OH$), 1, 3-propanediol ($HO(CH_2)_3OH$), 1, 4-butanediol ($HO(CH_2)_4OH$, 1, 5-pentanediol ($HO(CH_2)_5OH$), 1, 6-hexanediol ($HO(CH_2)_6OH$) and etc. which are represented by chemical formula $HO(CH_2)_mOH$.($m$ may range to 10). Trihydric alcohols includes glycerin ($HOCH_2CH(OH)CH_2OH$) and etc.

The object of the invention is to provide a new coloring method of synthetic resin articles which is able to color the resin surface in a short time without damaging the surface of said article. Another object of the invention is to provide a coloring method which is suitable for coloring small quantities and areas of resin articles in desired colors. A further object of the invention is to provide a coloring method for synthetic resin which does not need any expensive after-treatment. The above and other objects and features of the invention will become apparent from the following detailed description.

DETAILED DESCRIPTION OF THE INVENTION

Embodiments of the invention will be explained according to the Examples.

EXAMPLE 1

| | |
|---|---|
| suberic acid | 13.0% weight |
| ethylene glycol | 26.0% weight |
| water | 60.0% weight |

-continued

| | |
|---|---|
| dye belongs to blue group | 1.0% weight |

Keeping the coloring solution of above composition at the temperature of 68° C, an extruded article of acrylate resin is dipped into said solution for 1 minute ½. After taking the article out of the solution, it is washed by water and dried. The article is uniformly colored in blue, while retaining its original high hardness, brightness of the surface of the resin and good transparency even just after the coloring.

EXAMPLE 2

| | |
|---|---|
| azelaic acid | 2.0% weight |
| ethylene glycol | 29.0% weight |
| water | 68.0% weight |
| dye belongs to red group | 1.0% weight |

Keeping the coloring solution of above composition at the temperature of 68° C, an extruded article of acrylate resin is dipped into said solution for 3 minutes and is treated in a same way as Example 1. The article is uniformly colored in red retaining its high hardness and brightness of the surface of the resin and good transparancy even just after the coloring.

EXAMPLE 3

| | |
|---|---|
| sebacic acid | 1.3% weight |
| ethylene glycol | 28.2% weight |
| water | 69.3% weight |
| dye belongs to yellow group | 1.2% weight |

Keeping the coloring solution of above composition at the temperature of 68° C, an extruded article of acrylate resin is dipped into said solution for 45 seconds and is treated in a same way as Example 1. The article is uniformly colored in yellow, retaining its high hardness and brightness of the surface of the resin and good transparancy even just after the coloring.

EXAMPLE 4

| | |
|---|---|
| azelaic acid | 1.5% weight |
| 1,3-propanediol | 26.5% weight |
| water | 71.0% weight |
| dye belongs to green group | 1.0% weight |

Keeping the coloring solution of above composition at the temperature of 83° C, a sheet of polyester film (mylar film) is dipped into said solution for 4 minutes. After taking the film out of the solution, it is washed by water and dried. The film is uniformly colored in green, retaining its high hardness and brightness of the surface of the film and good transparancy even just after the coloring.

EXAMPLE 5

| | |
|---|---|
| sebacic acid | 1.5% weight |
| 1,3-propanediol | 26.5% weight |
| water | 71.0% weight |
| dye belongs to blue group | 1.0% weight |

Keeping the coloring solution of above composition at the temperature of 90° C, an extruded article of epoxy resin is dipped into said solution for 3 minutes and 30 seconds. After taking the article out of the solution, it is washed by water and dried. The article is uniformly colored in dark blue, retaining its high hardness and brightness. The state of surface is not changed by this coloring treatment even just after the coloring.

EXAMPLE 6

| | |
|---|---|
| suberic acid | 50% weight |
| ethylene glycol | 14% weight |
| water | 35% weight |
| dye belongs to blue group | 1% weight |

While keeping the coloring solution of above composition at the temperature of 68° C, some crystals can be seen in the solution. An extruded article of acrylate resin is dipped into said solution for 4 minutes. When the article is taken out of the solution, some crystals of suberic acid are attached on the surface of the article. After washing and drying, it was found that the article was colored in blue, retaining its high hardness and brightness of the surface of the resin and good transparancy even just after the coloring. If the quantity of suberic acid is increased, the quantity of crystals attaching to the surface of the article is increased. This often causes the difficulty for after-treatment. Thus it is understood that solutions containing larger amounts of suberic acid are not suitable for industrial practical use but adequate for experimental purposes.

EXAMPLE 7

| | |
|---|---|
| sebacic acid | 1.3% weight |
| ethylene glycol | 28.2% weight |
| water | 69.3% weight |
| dye belongs to blue group | 1.2% weight |

Keeping the coloring solution of above composition at the temperature of 70° C, an extruded article of polyacetal resin is dipped into said solution for 1 minute. After taking the article out of the solution, it is washed by water and dried. The article is uniformly colored in blue, retaining its high hardness and brightness of the surface of the resin and good transparancy even just after the coloring.

EXAMPLE 8

| | |
|---|---|
| sebacic acid | 1.0% weight |
| ethylene glycol | 28.0% weight |
| water | 70.0% weight |
| dye belongs to brown group | 1.0% weight |

Keeping the coloring solution of above composition at the temperature of 57° C, a sheet of metal plate is dipped into said solution for 30 seconds. The metal plate is previously coated with clear lacquer belonging to the cellulose derivative groups. After taking the coated plate out of the solution, it is washed by water and dried. The plate is uniformly colored in brown, the coating retaining its high hardness and brightness of the surface and good transparancy even just after the coloring.

EXAMPLE 9

| | |
|---|---|
| sebacic acid | 1.7% weight |
| azelaic acid | 1.7% weight |
| ethylene glycol | 27.0% weight |

-continued

| | |
|---|---|
| water | 67.9% weight |
| dye belongs to blue group | 1.7% weight |

Keeping the coloring solution of above composition at the temperature of 68° C, an extruded article of acrylate resin is dipped into said solution for 2 minutes. After taking the article out of the solution, it is washed by water and dried. The article is uniformly colored in blue, retainings it high hardness and the brightness of the surface of the resin and good transparancy even just after the coloring.

EXAMPLE 10

| | |
|---|---|
| sebacic acid | 2.6% weight |
| ethylene glycol | 13.7% weight |
| 1,3-propanediol | 13.7% weight |
| water | 68.3% weight |
| dye belongs to blue group | 1.7% weight |

Keeping the coloring solution of above composition at the temperature of 68° C, an extruded article of acrylate resin is dipped into said solution for 4 minutes. After taking the article out of the solution, it is washed by water and is dried.

The article is uniformly colored in blue, retaining its high hardness and brightness of the surface of the resin and good transparancy even just after the coloring.

EXAMPLE 11

| | |
|---|---|
| sebacic acid | 2.5% weight |
| azelaic acid | 3.3% weight |
| ethylene glycol | 13.2% weight |
| 1,3-propanediol | 13.2% weight |
| water | 66.1% weight |
| dye belongs to blue group | 1.7% weight |

Keeping the coloring solution of above composition at the temperature of 68° C, an extruded article of acrylate resin is dipped into said solution for 3 minutes. After taking the article out of the solution, it is washed by water and dried. The article is uniformly colored in blue, retaining its high hardness and brightness of the surface of the resin and good transparancy even just after the coloring.

Other synthetic resin, such as polyurethane resin, polyamide resin, polycarbonate resin, acrylonitrile-butadiene-styrene copolymer (ABS) resin, polyvinyl chloride resin, etc., are possible to color in a same way. It is also possible to color a resin film by dyes, of which the main component of the films are any of the above resins.

The color or tone is not limited by the kind of resin which is used as a base and other than colors disclosed in the embodiments, it may be colored in purple, orange, black etc.

The colored samples according to each Example were submitted to various tests such as rubbing test with cotton gauze and abrasion with rubber office eraser, dipping tests in artificial sweat, in a solution of three per cent salt, and in soap solutions. The color tone of each sample was not changed by these tests. Other colored samples were aged in storage rooms for 6 months, and they kept the same color condition without fading, color change, color irregularity and appearance of spots.

Polyacid according to this invention must be selected from the group of acids having normal straight chain linear molecules with carboxyl radical at the ends.

The preferable range of polyacid for the coloring treatment of this invention is from 0.1 weight percent to 50 weight percent of the treating solution. If the quantity of polyacid is less than 0.1 weight percent, the synthetic resin is not colored visually. If it is more than 50 weight percent, the surface of the resin is apt to be etched, and after-treatment becomes tedious and expensive owing to the presence of recrystallized polyacid on the surface. In case the number of "*n*" in chemical formula of polyacid is too low, (below 4) esterification reaction between polyacid and polyhydric alcohol is apt to begin, and the coloring ability becomes weak and the active life of the solution is shortened. The preferable range of polyhydric alcohol which dissolves polyacid is from 5 weight percent to 50 weight percent. The polyacids are difficulty soluble if the polyhydric alcohol concentration is less than 5 weight percent of the solution. Coloring reaction is disturbed in polyhydric alcohol more than 60 weight percent. Among the polyhydric alcohols; dihydric alcohols and trihydric alcohols are preferable, particularly dihydric alcohols are the best for practical use. In case the number of "m" in chemical formula of dihydric alcohol ($HO(CH_2)_m$-OH) is too high ("*m*" is greater than 10), it is difficult to color synthetic resin. Monohydric alcohols are not suitable for practical use, because of their tendency to attack and swell the surface of the synthetic resin. There is no limitation about the quantity of dye included in the solution, but its range is generally from 1 weight percent to 3 weight percent for economic reasons.

According to the invention, the surface of synthetic resin is easily colored in a short time without damaging the surface. There is no need of special after-treatment except for washing and drying. It is possible to color in almost every color, such as red, orange, yellow, green, blue, purple, brown and black, etc. except white, and there is no limitation of color tone by the kinds of synthetic resin. The shade or intensity of the color is freely changeable by adjusting the coloring conditions such as dipping time, bath temperature and composition of the bath solution, and quantity and nature of dye. Since the dyes attach only on the surface of the resins and do not permeate into resins, the surface of the resins is not dissolved and the properties of the resins are not deteriorated.

According to the invention, the external appearance of the colored resin is not distinguishable from that of the resin in which ordinary dye is pre-mixed. It is also possible by this invention to color articles in such ways as; partial coloring; gradation coloring or in a pattern configuration by adjusting the application of the dye solution either in or out of bath treatment. The coloring solutions may be applied at elevated temperatures by padding spraying the articles with or without masks for patterned coloring.

There are three types of suitable dyestuff, such as Disperse Dyes, Acid Dyes and Cationic Dyes. Following list shows the name of dyes and their correspondence to Color Index. They all belong to Disperse Dyes and were used actually.

| NAME OF DYES | | | COLOR INDEX |
|---|---|---|---|
| Sumikaron | Yellow | E-6GL | Disperse Yellow 51 |
| Sumikaron | Yellow | S-R | |

-continued

| NAME OF DYES | | | COLOR INDEX |
|---|---|---|---|
| Sumikaron | Red | S-GG | |
| Sumikaron | Violet | E-2R1 | |
| Sumikaron | Violet | RSL | Disperse Violet 23 |
| Sumikaron | Blue | E-GRL | |
| Sumikaron | Blue | E-FBL | Disperse Blue 26 |
| Sumikaron | Blue | S-2GL | |
| Sumikaron | Turquoise Blue | S-GL | |
| Sumikaron | Yellow Brown | S-2RL | |
| Sumikaron | Brown | S-5RL | |
| Sumikaron | Navy Blue | S-2GL | |
| Sumikaron | Blck | S-BL | |
| Kayalon | Fast | Blue FN | Disperse Blue 3 |
| Kayalon | Fast | Rubine B | Disperse Red 13 |
| Kayalon | Fast | Blue Green B | Disperse Blue 7 |
| Kayalon | Fast | Brown R | Disperse Orange 5 |
| Kayalon | Polyester | Yellow YLF | |
| Kayalon | Polyester | Red Violet RSF | |
| Kayalon | Polyester | Blue GRF | Disperse Blue 97 |

Even if after storing the colored resins for a long time, the color condition is maintained without color change or color irregularity and the attached color, on the surface of resin, is not peeled off by washing or rubbing.

Since no chemicals having poisonous character and no organic solvents are used for coloring, there is no need to prepare special facilities such as solvent recovery and storage and no need for expensive vapor exhaust facilities. As a result it is also profitable from the point of anti-pollution countermeasure.

It is needless to say that the process to color the surface of resin according to this invention may easily be practical continuously by automatic equipment. While preferred embodiments of the invention have been shown and described it will be understood that many modifications and changes can be made within the true spirit and scope of the invention.

What is claimed is:

1. A coloring method for the surfaces of synthetic resin articles comprising, the step of heating an aqueous dye solution to a temperature less than the softening temperature of said resin; and applying the heated aqueous solution to the article to be colored; wherein said aqueous solution consisting, essentially of 0.1–50 weight percent of at least one polyacid having the chemical formula $HO_2C(CH_2)_nCO_2H$ wherein *n* is integer of at least 4 and sufficient to inhibit esterification of said polyacid with polyhydric alcohol; 5–60 weight percent of at least one polyhydric alcohol and an effective quantity of a resin-substantive dye in water.

2. The coloring method for synthetic resins according to claim 1, wherein are at least one polyacid is selected from the group consisting of adipic acid, pimelic acid, suberic acid, azelaic acid, sebacic acid, dodecanedioic acid, brassylic acid and tetradecanedioic acid.

3. The coloring method for synthetic resins according to claim 1, wherein the polyhydric alcohols are selected from dihydric alcohols of the group consisting of ethylene glycol, propanediol, butanediol, pentanediol and hexanediol, and the group of trihydric alcohols including glycerin.

4. The coloring method for synthetic resin according to claim 1, therein the article is immersed in the aqueous solution said solution being heated to the temperature range from 50° C to 95° C for at least 30 seconds.

5. The coloring method for synthetic resin according to claim 1 wherein said heated aqueous solution is applied by contacting said solution in the desired areas.

6. The method according to claim 5 wherein the contacting is by spraying to the desired areas.

7. The method according to claim 6 wherein the spraying to the areas is controlled by masks.

8. The method according to claim 5 wherein the contacting is by padding in the desired areas.

9. A coloring method for articles comprising synthetic resins, which comprises the steps of maintaining an aqueous solution for coloring the synthetic resins at a temperature in the range 50° to 95° C, but below the softening point of the resin components of said article, and contacting said heated solution with the resins in said article in the areas to be colored; wherein said aqueous solution consisting essentially of 1–15 weight percent of at least one polyacid having the chemical formula $HO_2CH(CH_2)_nCO_2H$, wherein "$n$" is an integer of at least 4; 25–30 weight percent of at least one polyhydric alcohol; and 1 to 3 weight percent of a resin-substantive dye, in water.

* * * * *